United States Patent [19]

Kawashima

[11] 3,968,545

[45] July 13, 1976

[54] SLIDE FASTENER SLIDER

[75] Inventor: Teruaki Kawashima, Namerikawa, Japan

[73] Assignee: Yoshida Kogyo Kabushiki Kaisha, 03, ; JA

[22] Filed: June 5, 1974

[21] Appl. No.: 476,427

[30] Foreign Application Priority Data

June 14, 1973 Japan ..... 48-70928[U]

[52] U.S. Cl. ..... 24/205.15 R

[51] Int. Cl.[2] ..... A44B 19/26

[58] Field of Search ..... 24/205.15 R, 205.15 E, 24/205.1 R

[56] References Cited

UNITED STATES PATENTS

| | | | |
|---|---|---|---|
| 2,072,200 | 3/1937 | Devore | 24/205.15 R |
| 2,092,538 | 9/1937 | Sundback | 24/205.15 R |
| 2,095,270 | 10/1937 | Silberman | 24/205.15 R |
| 2,160,819 | 6/1939 | Behrens | 24/205.15 R |
| 2,240,048 | 4/1941 | Morin | 24/205.15 E |
| 2,296,831 | 9/1942 | Bloxsom | 24/205.15 R |
| 2,325,709 | 8/1943 | Samstegman | 24/205.15 R |
| 2,495,176 | 1/1950 | Nissen | 24/205.15 E |
| 2,677,162 | 5/1954 | Foltis | 24/205.15 R |
| 2,807,853 | 10/1957 | Chery | 24/205.15 E |
| 2,911,699 | 11/1959 | Koehler | 24/205.15 E |

FOREIGN PATENTS OR APPLICATIONS

| | | | |
|---|---|---|---|
| 561,676 | 11/1957 | Belgium | 24/205.15 R |
| 772,437 | 4/1957 | United Kingdom | 24/205.15 E |

*Primary Examiner*—Bernard A. Gelak
*Attorney, Agent, or Firm*—Bucknam and Archer

[57] ABSTRACT

A slide fastener slider is disclosed, which slider comprises an upper wing and a lower wing constituting a slider body and connected together at one end by a neck or wedge. One of the wings is provided with diverging shoulders, while the other is provided with conversely offset shoulders, resulting in an asymmetric wing structure wherein there is formed an open area on opposite sides of the wedge. This open area serves to reduce the tendency of stringer tapes to become creased or wrinkled as and when they arrive at the entrance end of the slider.

1 Claim, 7 Drawing Figures

SLIDE FASTENER SLIDER

BACKGROUND OF THE INVENTION

This invention relates to improvements in and relating to a slider for slide fasteners and more particularly to a slider of the character which is suitable for mounting on and manipulating such heavy duty slide fasteners or zippers which are applied to joints in partition members such as oil fence or seams in hoods for trains and automobiles. There are known slide fastener sliders constructed with symmetrically disposed top and bottom wing members, these wing members being connected at one end by a neck portion and flared or otherwise enlarged transversely on opposite sides of the neck portion so as to permit a top end stop to be fully retracted into and anchored between the enlarged portions of the wing members. While sliders of this type have the advantage that they can be retained firmly in locked relation with the fastener stringers, such prior-art sliders have suffered from the fatal drawback that the fastener stringer tapes are liable to become objectionably creased or wrinkled along their edge portions, to which rows of fastener elements are secured, as the fastener elements are drawn through the guide channel in the slider and such creased or wrinkled portions of the stringer tapes tend to get jammed between the fastener elements and the flanges of the wing members, with the results that the slider becomes inoperative. This tendency is pronounced particularly with slide fasteners attached to relatively rigid objects such as for example hoods for trains and automobiles.

SUMMARY OF THE INVENTION

In view of the noted deficiencies of the prior art, it is an object of the present invention to provide an improved construction for a slide fastener slider whereby the tendency of stringer tapes to become creased or wrinkled is held to an absolute minimum and smooth, reliable functioning of the slider is achieved.

Another object of the invention is to provide an improved slider having a twin pull tab structure adapted to retain the slider positively in locked position relative to the stringer tapes.

With these objects in view, this invention provides a crease-relieving area in a slider in the vicinity of an entrance end thereof at which a connecting neck is provided to connect a top and a bottom wing member. The crease-relieving area is adapted to allow the fastener elements upon arrival thereat to tilt both longitudinally and transversely of the fastener in a manner to relieve or disperse the creases or wrinkles that have been created in the stringer tapes upon approaching the entrance end of the slider. There are provided a pair of substantially identical pull tabs carried pivotally on the top and bottom wing members, respectively, one of which pull tabs having a male portion engageable with a female portion of the other pull tab such that engagement of these portions will establish a positive lock of the slider relative to the fastener.

The features which are believed to be novel and characteristic of this invention are set forth with particularity in the appended claims. The invention itself, however, both as to its construction and manner of operation, will become more apparent from the following description of preferred, representative embodiment taken in connection with the accompanying drawings in which like reference characters denote like parts throughout the several views.

DESCRIPTION OF THE PREFERRED EMBODIMENT

Figure 1:
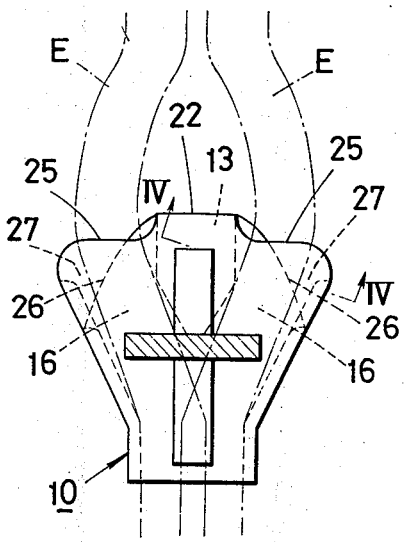
FIG. 1 is a plan view of a slider provided in accordance with the invention.
Figure 2:
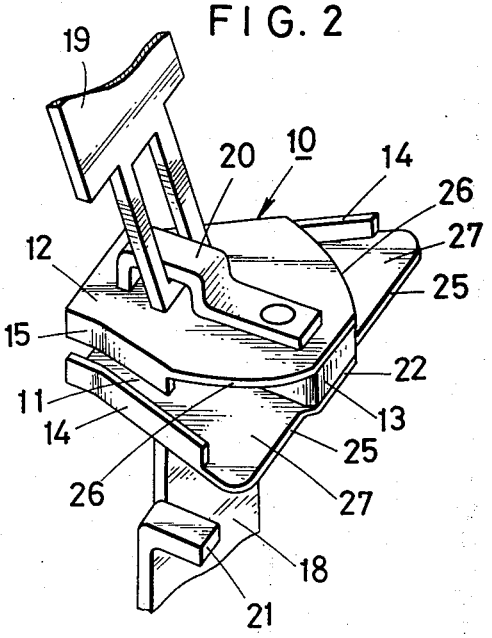
FIG. 2 is a perspective view of the slider, showing the same upside down.

Referring now to the drawings and FIGS. 1 and 2 in particular, there is shown a slide fastener slider 10 which comprises an upper wing 11 and a lower wing 12 constituting a slider body and connected together at one end by a neck portion 13. The upper and lower wings 11,12 are provided with inwardly directed side flanges 14,15 respectively and are configured to define with the neck portion 13 a substantially Y-shaped guide channel 16 through which a slide fastener F is allowed to pass in the well known manner. A supporting lug 17 projects upwardly from the one or upper wing 11 and is adapted to carry a pull tab 18 pivotally thereon. A similar additional pull tab 19 is also provided in accordance with the invention, which pull tab 19 is pivotally connected to another supporting lug 20 on the other or lower wing member 12.

There is provided a locking prong 21 secured to or formed integrally with at least one of the two pull tabs 18,19 and adjacent at least either of opposite sides of the lug 17 (or 20). In the illustrated embodiment, the locking prong 21 is adapted to extend slightly beyond an entrance end 22 of the slider 10 and engage in the space between adjacent fastener elements E or with a top end stop (not shown) thereby to lock the slider 10 against movement relative to the fastener F. This locking engagement is established by joining the two pull tabs 18,19 together beyond and forwardly of the entrance end 22 of the slider 10 when the slider 10 has been brought to a terminal end of the fastener F upon closing of the latter. To thus join the two pull tabs 18,19 together, there is provided a male engaging member or socket 23 on the one or lower pull tab 19 which is engageable snappingly with a female engaging member or socket receptacle 24 on the other or upper pull tab 18, as better shown in FIG. 3, when the two pull tabs are flipped down back to back.

Now, according to the invention, one of the wings 11,12 (or the upper wing 11 in the illustrated embodiment) is provided with diverging or transversely elongated shoulders 25, while the other or lower wing 12 had conversely offset or progressively reduced shoulders 26, resulting in an asymmetric wing structure such as seen in FIGS. 1 and 2. This arrangement provides an enlarged open area 27 on opposite sides of the neck portion 13 and in the vicinity of the entrance end 22 of the slider 10 at which the fastener F is drawn into the guide channel 16. The provision of the open area 27, which is characteristic of the invention, is intended to reduce the tendency of stringer tapes T to become creased or wrinkled as and when they arrive at the entrance end 22 of the slider in a manner hereinafter described.

Figure 5:
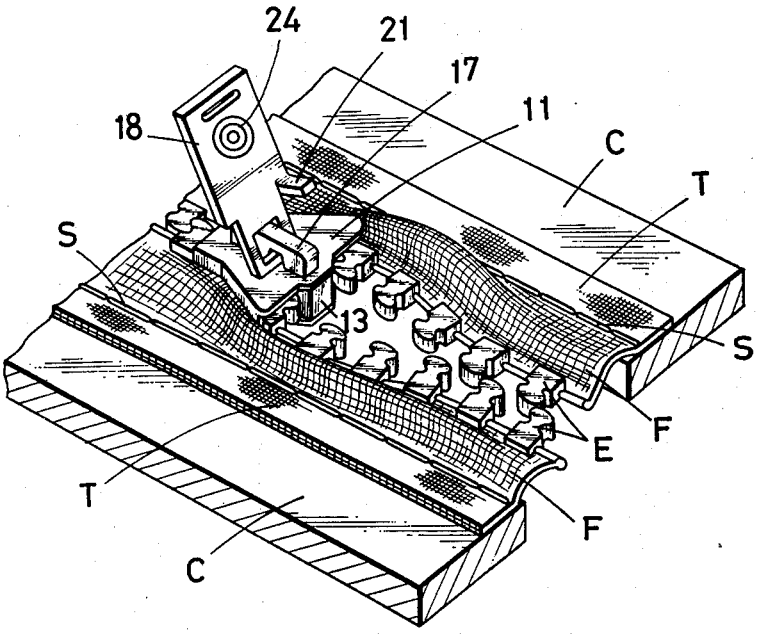
FIG. 5 is a perspective view of the slider, showing the same in movement relative to a slide fastener chain.
Figure 6:
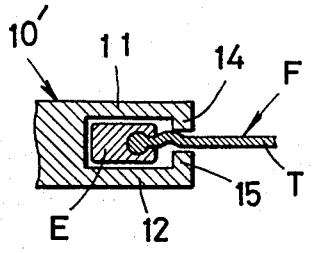
FIGS. 6 and 7 are transverse cross-sectional views, respectively in part of a conventional type of slider, utilized to explain the jamming of a stringer tape between adjacent fastener elements and the slider flanges.
Figure 7:
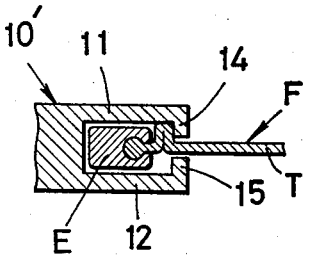

Reference to FIG. 5 shows the above constructed slider 10 mounted on a slide fastener F comprising a pair of stringer tapes T each carrying along one edge a row of fastener elements E and secured as by stitches S to a relatively stiff article C. Due to the article C being stiff and heavy as in the case of hoods in trains or automobiles, the stringer tapes T are liable to become creased or otherwise deformed under the influence of severe stresses applied by the slider 10 during movement thereof along the fastener elements E to open or close the fastener F. Such deformation of the stringer tapes T has been augmented with the conventional slider 10' shown in FIGS. 6 and 7 from which it will be seen that a portion of the stringer tape T adjacent the row of fastener elements E tends to rise and is squeezed between the elements E and the slider flange 14 as the fastener F is opened or closed by the slider 10', thus impairing the function of the slider.

Figure 3:
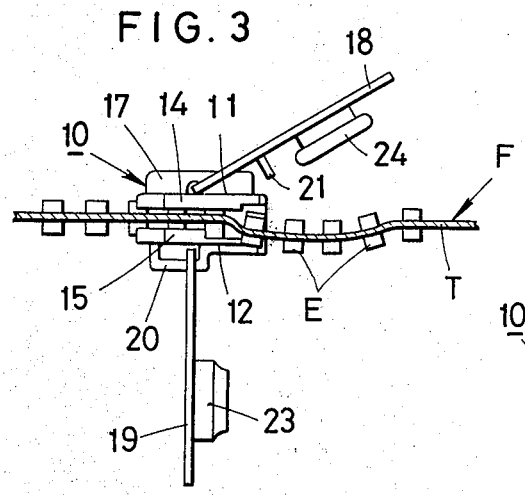
FIG. 3 is a side view of the slider shown as mounted on a slide fastener chain.
Figure 4:
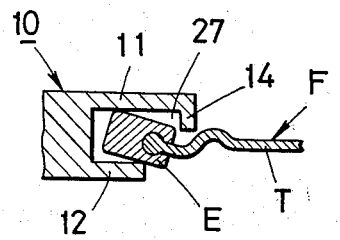
FIG. 4 is a transverse cross-sectional view taken on the line IV—IV of FIG. 1.

Advantageously according to the invention, such deformation of the stringer tapes T are held to an absolute minimum so that the slider 10 can be smoothly manipulated without becoming jerket by jammed stringer tapes. This is achieved by the improved construction of the slider 10 herein disclosed wherein the open area 27 functions to relieve the creases or wrinkles that may develop in the stringer tapes T upon approaching or arrival at the entrance end 22 of the slider 10. More specifically, when the stringer tapes T are drawn through the guide channel 16 in a fastener closing direction, the fastener elements E upon entry into the open area 27 are allowed to tilt longitudinally of the fastener F as seen in FIG. 3 and also transversely within the region of the open area 27 as seen in FIG. 4, in a manner yielding to and dispersing the stresses applied to the stringer tapes T adjacent the neck portion 13, so that the magnitude of creases or wrinkles in the tapes T is minimized and deflected outwardly of the side flanges 14,15 of the slider 10.

While the invention has been described and shown as to a preferred embodiment, it will be understood that the invention is not limited to the precise form and construction advanced herein, but various changes and modification may be made therein without departing from the scope of the appended claims.

What is claimed is:

1. A slider for a slide fastener having rows of interengageable fastener elements carried by respective stringer tapes comprising an upper wing and a lower wing disposed in generally parallel relation and each having an inwardly directed flange and connected together at one end by a neck portion and a pull tab pivotally carried at least on one of said upper and lower wings, the flange of one of said wings being shorter than that of the other wing, said wings having unobstructed end edges, one of said wings having a transversely diverging shoulder on opposite sides of said neck portion, with the corresponding shoulder of the other wing being offset relative to said diverging shoulder to provide an open area where the upper and lower wings are not superimposed, said open area having a configuration allowing the fastener elements upon entry into said open area to tilt longitudinally and transversely to relieve creases in the stringer tapes.

* * * * *